US005381923A

United States Patent [19]

O'Dea

[11] Patent Number: 5,381,923

[45] Date of Patent: Jan. 17, 1995

[54] OVERFLOW CONTROL FOR LIQUID STORAGE TANKS

[75] Inventor: Richard W. O'Dea, Kirkwood, N.Y.

[73] Assignee: Highland Tank & Manufacturing Company, Stoystown, Pa.

[21] Appl. No.: 90,802

[22] Filed: Jul. 12, 1993

[51] Int. Cl.[6] ..... B65D 51/00

[52] U.S. Cl. ..... 220/565; 20/4.12; 20/501

[58] Field of Search ..... 220/565, 501, 465, 4.12

[56] References Cited

U.S. PATENT DOCUMENTS

| | | | |
|---|---|---|---|
| 1,775,484 | 9/1930 | Brainich | 220/501 X |
| 2,703,607 | 3/1955 | Simmonds | 220/501 X |
| 4,638,920 | 1/1987 | Goodhues, Jr. | 220/565 X |
| 4,685,585 | 8/1987 | Robbins | 220/4.12 X |
| 4,895,272 | 1/1990 | De Benedittis et al. | 220/85 |
| 5,197,627 | 3/1993 | Disabato et al. | 220/4.12 X |

OTHER PUBLICATIONS

Four Page Brochure of Areo-Power showing above--ground storage tanks.

Two Page Brochure of Areo-Power Showing above--ground storage tanks.

*Primary Examiner*—Steven M. Pollard

*Attorney, Agent, or Firm*—Buchanan Ingersoll

[57] ABSTRACT

An overflow control for liquid storage tanks is provided. Fluid overflowing from the inlet port or a vent port of a liquid storage tank is collected within a spill collection chamber that overlies the inlet port and the vent port. The spill collection chamber also overlies a spill storage chamber that receives liquid from the spill collection chamber when the liquid in the spill collection chamber raises to a level sufficient to enter the inlet port of the spill storage chamber. The spill collection chamber is formed in fluid tight relationship to the storage tank and to the spill storage chamber. The liquid storage tank may also be positioned within a dike that has a second spill collection chamber to capture overflow from the tank spill collection chamber.

19 Claims, 8 Drawing Sheets

OVERFLOW CONTROL FOR LIQUID STORAGE TANKS

BACKGROUND OF THE INVENTION

1. Field of the Invention

This invention relates to a system and apparatus for the control of overflow from liquid storage tanks, particularly petroleum product storage tanks, to prevent the overflow from contaminating the environment.

2. Description of the Prior Art

Overflow control of liquid storage tanks has been a problem with various liquids, and particularly with petroleum products. Storage tanks are subject to random product releases caused by overfilling and by product expansion. The overflow releases emanate from the fill pipe or from the emergency venting device, or both. If no overflow control is provided, the liquid product leaves the tank and ultimately enters the environment around the tank. Such action contaminates soil and water resources converting them to hazardous material subject to costly handling and clean up processes.

In the past, various proposals have been utilized for controlling overflow. Fill pipe overflow containers have been proposed with various funnel-like arrangements to collect the overflow and guide it to a container. Many liquid storage tanks are situated within box-like dikes that serve as a safety arrangement to collect any overflow that may leave the tank and prevent it from reaching the soil around the tank. The prior art does not provide for a single weatherproof integrated system capable of handling fill and vent releases concurrently in a staged manner. The present invention does provide such a system.

SUMMARY OF THE INVENTION

In accordance with the present invention there is provided apparatus for liquid overflow control of a liquid storage vessel having an inlet port and a vent port. A spill collection chamber overlies the storage vessel inlet port and the storage vessel vent port and is sealingly affixed to the storage vessel whereby liquid overflowing from the inlet port or from the vent port is contained within the spill collection chamber. A spill storage chamber is in fluid communication with the spill collection chamber so that liquid from the spill collection chamber subsequently enters the spill storage chamber for storage until it is removed from the spill storage chamber.

Further, in accordance with the present invention, there is provided a vessel for liquid storage that has a cylindrical primary storage chamber positioned with its cylindrical axis in a horizontal direction and that has an inlet port and a vent port opening through the upper cylindrical surface of the primary storage chamber. A cylindrical spill storage chamber is attached to one end of the primary storage chamber and is axially aligned with the cylindrical primary storage chamber. The cylindrical spill storage chamber has an inlet port in its upper cylindrical surface and at least one drain port in the end wall of the cylindrical spill storage chamber. A spill collection chamber is positioned over a portion of the primary storage portion upper cylindrical surface and surrounds the primary storage chamber inlet port and vent port. The spill collection chamber is also positioned over a portion of the spill storage chamber upper cylindrical surface and is in fluid communication with the spill storage chamber inlet port whereby liquid leaving the primary storage chamber through the inlet port or through the vent port is collected within the spill collection chamber until it enters the cylindrical spill storage chamber.

In view of the foregoing, it is an object of the present invention to provide an improved overflow control for liquid storage tanks.

Another object of the present invention is to provide a liquid storage vessel that prevents contamination of the environment around the vessel in the event of accidental overflows from the vessel.

Another object of the invention is to provide a compact, self-contained storage vessel and overflow control system for liquid storage tanks.

These and other objects of this invention will become apparent as this description proceeds in conjunction with the accompanying drawings.

DESCRIPTION OF THE PREFERRED EMBODIMENTS

Figure 1:
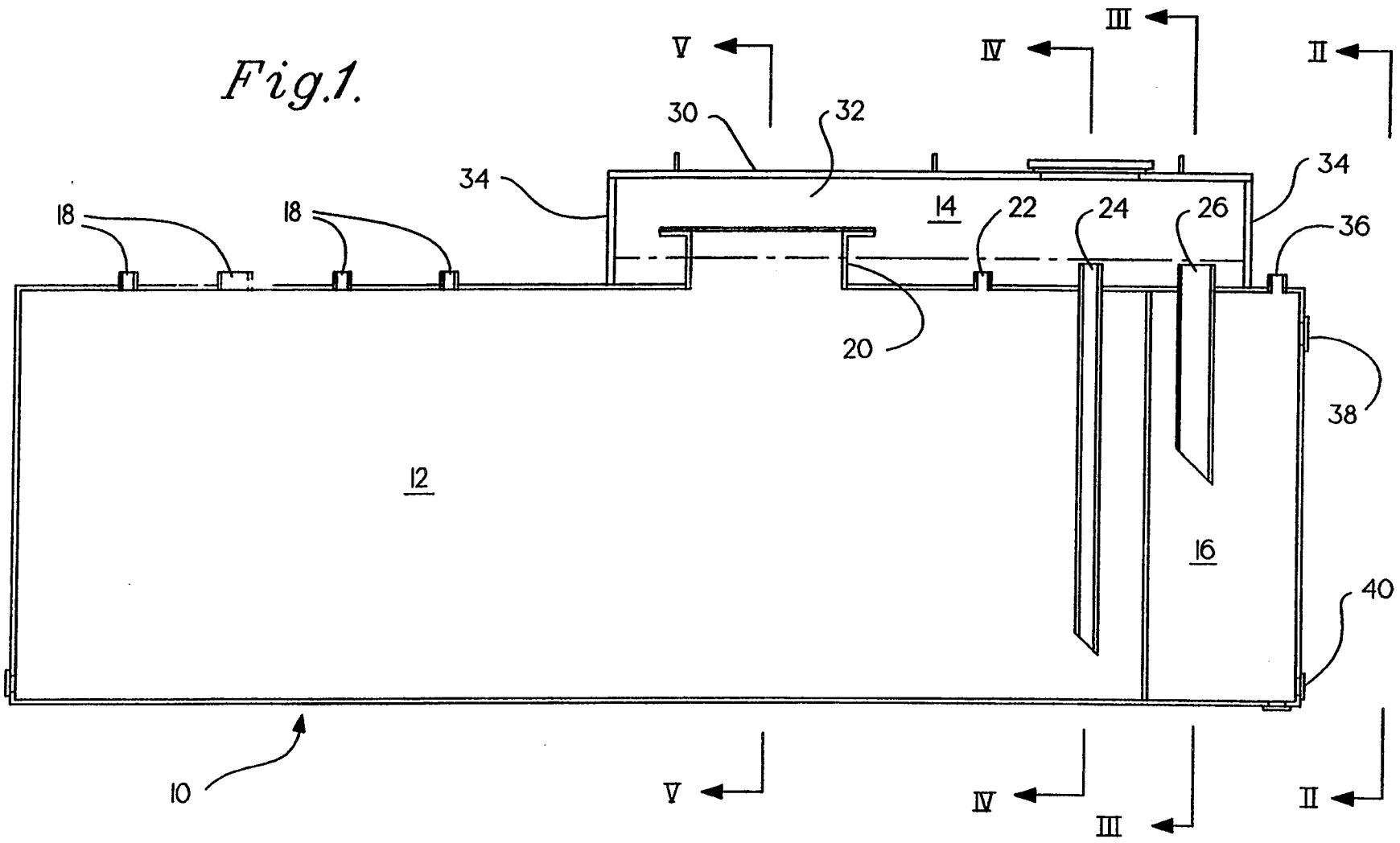
FIG. 1 is a sectional elevation of one embodiment of the present invention taken along line I—I of FIG. 2.
Figure 2:
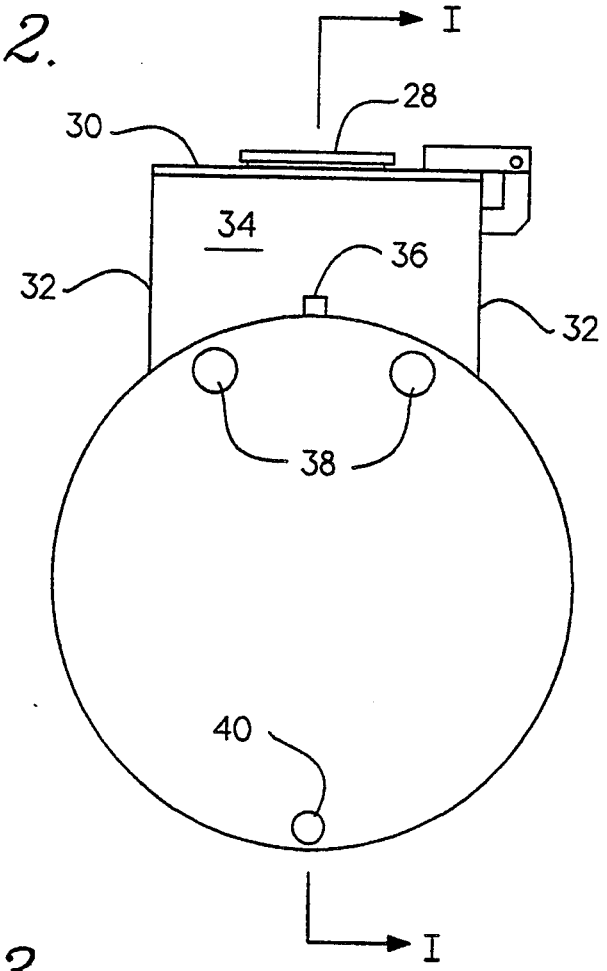
FIG. 2 is an end elevation viewed from line II—II of FIG. 1.
Figure 3:
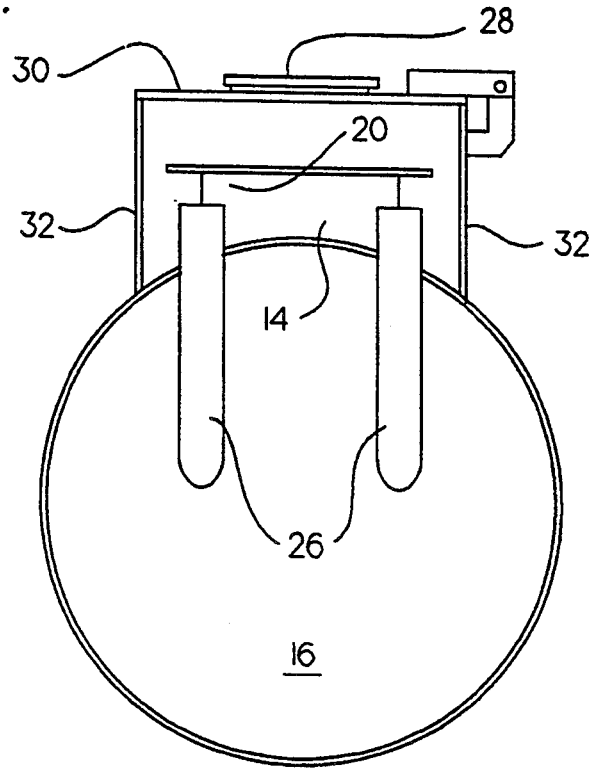
FIG. 3 is a sectional view taken along line III—III of FIG. 1.
Figure 4:
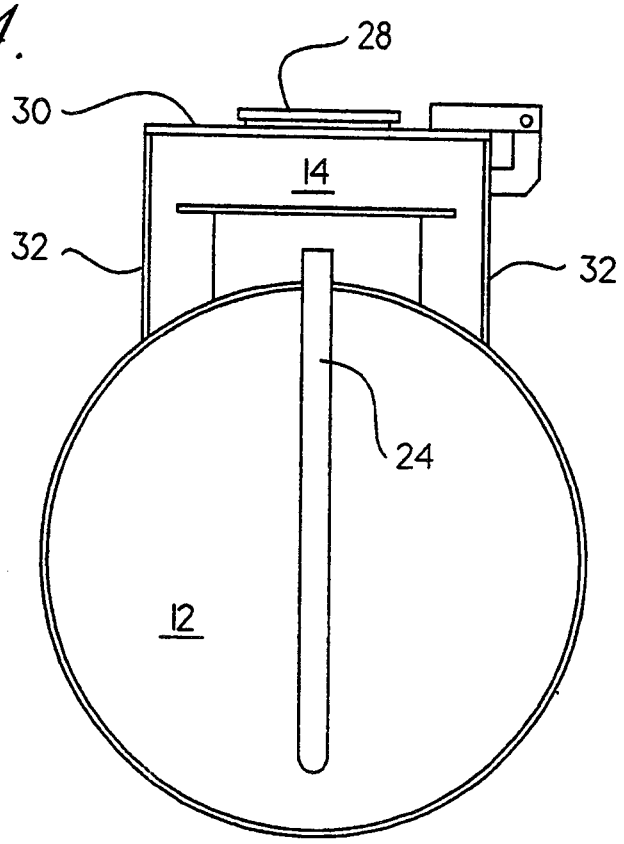
FIG. 4 is a sectional view taken along line IV—IV of FIG. 1.
Figure 5:
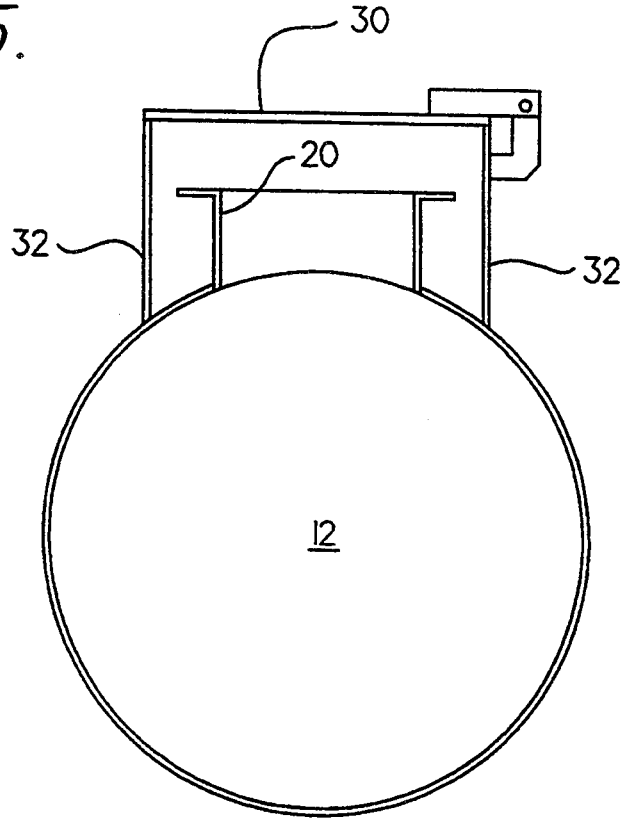
FIG. 5 is a sectional view taken along line V—V of FIG. 1.

The preferred embodiments of this invention will be described as applied to a liquid petroleum products storage tank. It will be appreciated that the invention is not limited to a storage tank for petroleum products but is equally applicable to any liquid storage vessel.

Referring now to the drawings, and particularly to FIGS. 1–5, there is shown a vessel indicated generally at 10 that has a primary storage chamber 12, a box-like spill collection chamber 14 and a spill storage chamber 16. The primary storage chamber 12 is preferably formed from a double wall tank although the invention is equally applicable to single wall tanks as well. The primary storage chamber 12 is a cylindrical tank with the axis of the cylindrical tank extending in a horizontal direction. The spill storage chamber 16 is also formed as a cylindrical tank which is integral with the primary storage chamber 12 but is a separate fluid chamber affixed to the end of primary storage chamber 12.

The primary storage chamber 12 has multiple pump and vent fittings 18 some of which are applicable to the outer tank and others of which are applicable to the inner tank of the double walled tank but none of which form any part of the present invention. The primary storage chamber 12 has a vent 20 which overflows in the event of fluid expansion within chamber 12 when chamber 12 is full. A gauge fitting 22 is provided for a fluid gauge for the primary storage chamber 12. An inlet port 24 to primary storage chamber 12 is in the form of a vertical pipe that extends above the cylindrical surface of primary storage surface 12 and extends down into the primary storage chamber 12. Two inlet ports 26 are formed in the spill storage chamber 16. Inlet ports 26 are pipes that extend vertically above the cylindrical surface of spill storage chamber 16 and down into the spill storage chamber.

A manhole having a cover 28 is formed in the hinged cover 30 of spill collection chamber 14. Spill collection chamber 14 has side walls 32 and end walls 34 to form a liquid tight, box-like structure that overlays the vent 20 and inlet port 24 of the primary storage chamber 12 as well as the inlet ports 26 of spill storage chamber 16. The spill storage chamber 16 has a vent 36, a pair of upper drains 38 and a lower drain 40. The drains 38 and 40 are formed in the end wall of the cylindrical chamber 16.

In operation of the system shown in FIGS. 1–5, the primary storage chamber 12 is filled by opening manhole cover 28 and inserting a nozzle into the inlet port 24 to the primary storage chamber 12. If the operator accidentally overfills the primary storage chamber 12, liquid will emerge from the vent 26 into the spill collection chamber 14. So long as the level of spilled liquid within spill collection chamber 14 remains below the level of inlet ports 26 to spill storage chamber 16, the spilled liquid will remain within the spill collection chamber 14 and can be cleaned from within the still collection chamber 14.

If the quantity of fluid overflowing from primary storage chamber 12 into spill collection chamber 14 rises to a level above the inlet ports 26 of spill storage chamber 16, the fluid from spill collection chamber 14 drains into the spill storage chamber 16 where it remains until it is removed. Liquid in spill storage chamber 16 may be removed by pump through upper drains 38 or it may be drained by gravity through lower drain 40.

The embodiment of the invention shown in FIGS. 1–5, inclusive, may be utilized for mounting above ground, or the primary storage chamber 12 and the spill storage chamber 16 may be buried underground with only the upper portion of the chambers 12 and 16 respectively, being above ground. If desired, several vessels in proximity to each other may have their spill storage chambers 16 connected to each other in fluid communication through drains 40 so that the overall capacity of several spill storage chambers 16 may be available in the event of a very large spill from one primary storage chamber 12. The spill storage chamber 16 is preferably of such a length that it provides from 10 to 25 percent of the storage capacity of primary storage chamber 12.

Figure 6:
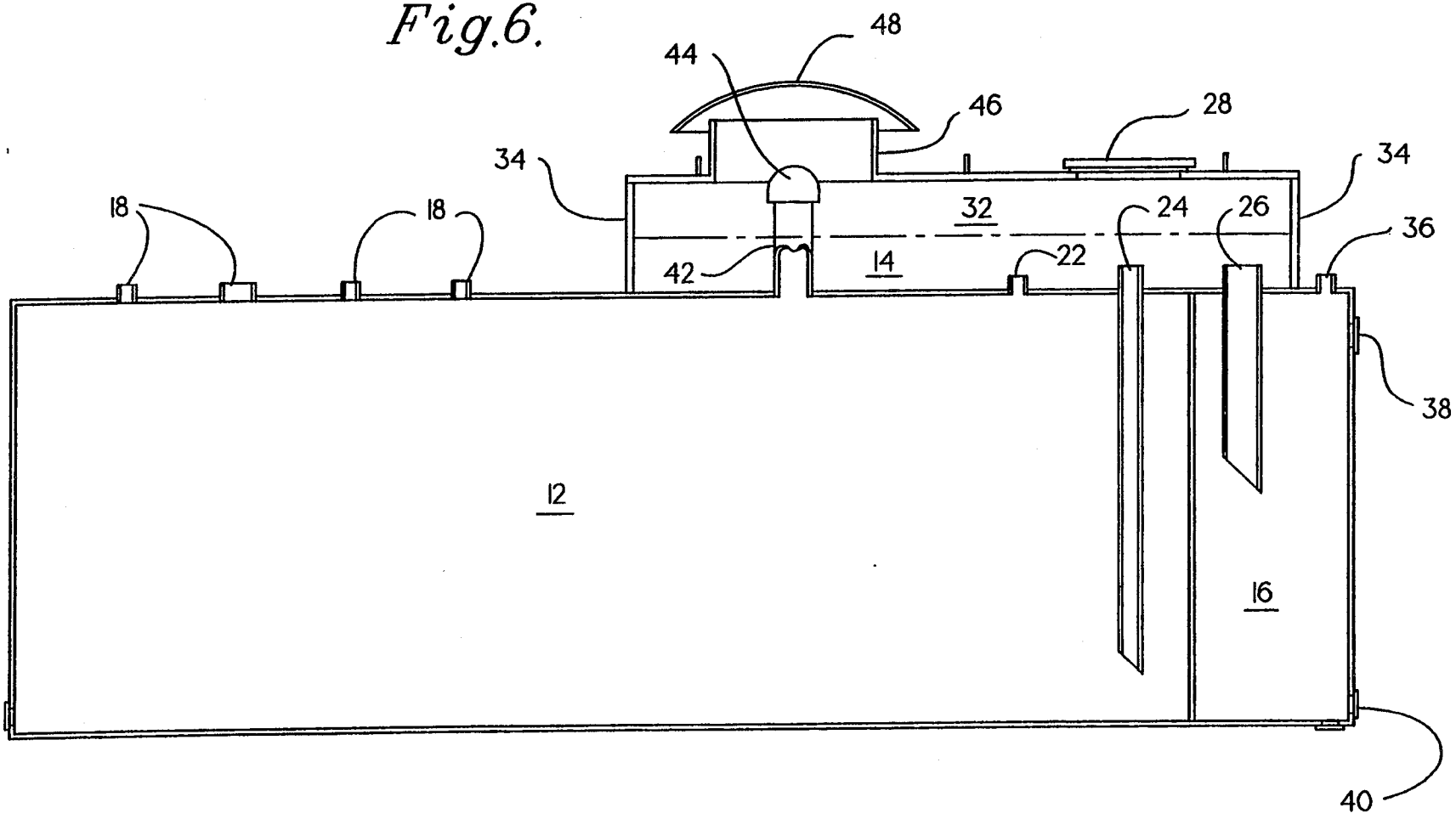
FIG. 6 is a sectional elevation similar no FIG. 1 showing a second embodiment of the present invention.

While the embodiment of the invention shown in FIGS. 1–5 may be utilized either above ground or underground, the embodiment of the invention shown in FIG. 6 is designed for above ground use. In FIG. 6 like reference numerals refer to the same components as the reference numerals in FIGS. 1–5. In the embodiment of FIG. 6, however, the emergency vent 42 is capped by a cap 44 which is moved upwardly under fluid pressure in the event that there is an overfull condition or thermal expansion in the primary storage chamber 12. The hinged cover 30 on spill collection chamber 14 has a vent housing 46 with a cover 48 to permit the escape of gases from spill collection chamber 14 if necessary. The fluid levels in chamber 14 function as described in connection with the embodiment in FIGS. 1–5 and when the level in the spill collection chamber 14 of FIG. 1 rises to the point where it exceeds the level of the inlet ports 26 to spill storage chamber 16, liquid drains from spill collection chamber 14 into spill storage chamber 16.

Figure 7:
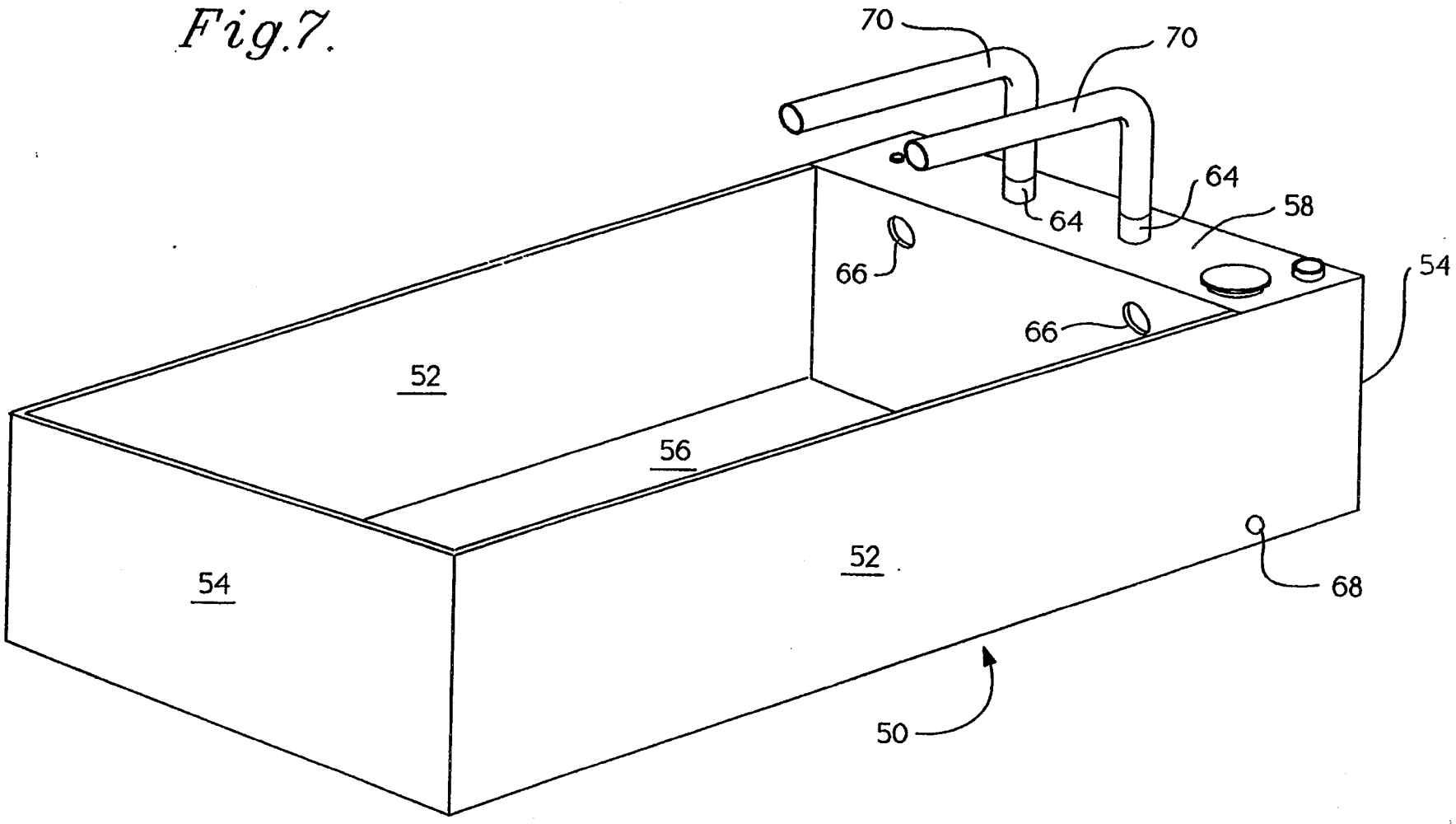
FIG. 7 is a perspective view of a dike arrangement embodying the present invention.
Figure 8:
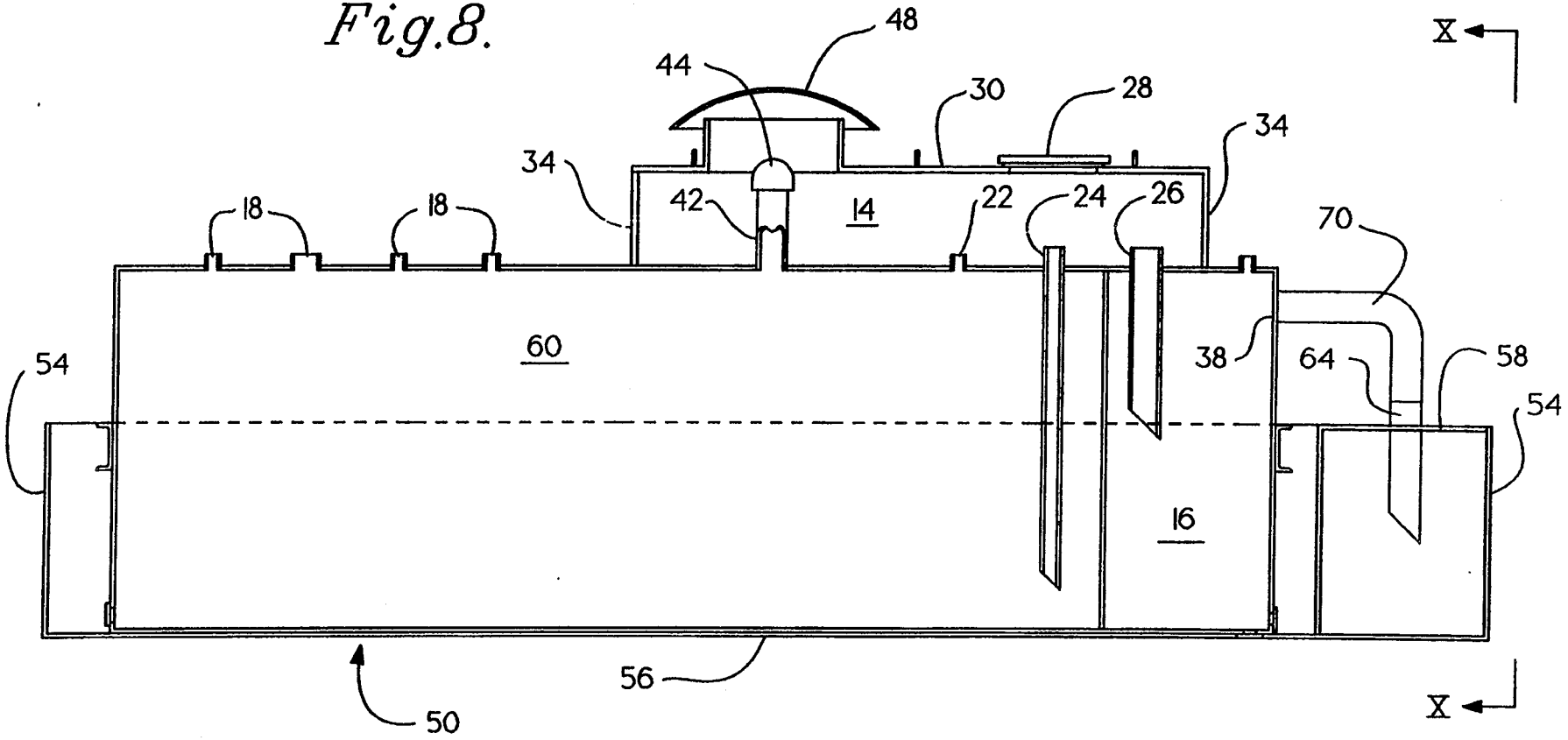
FIG. 8 is a sectional elevation similar no FIGS. 1 and 6 showing the invention in use with a dike.
Figure 9:
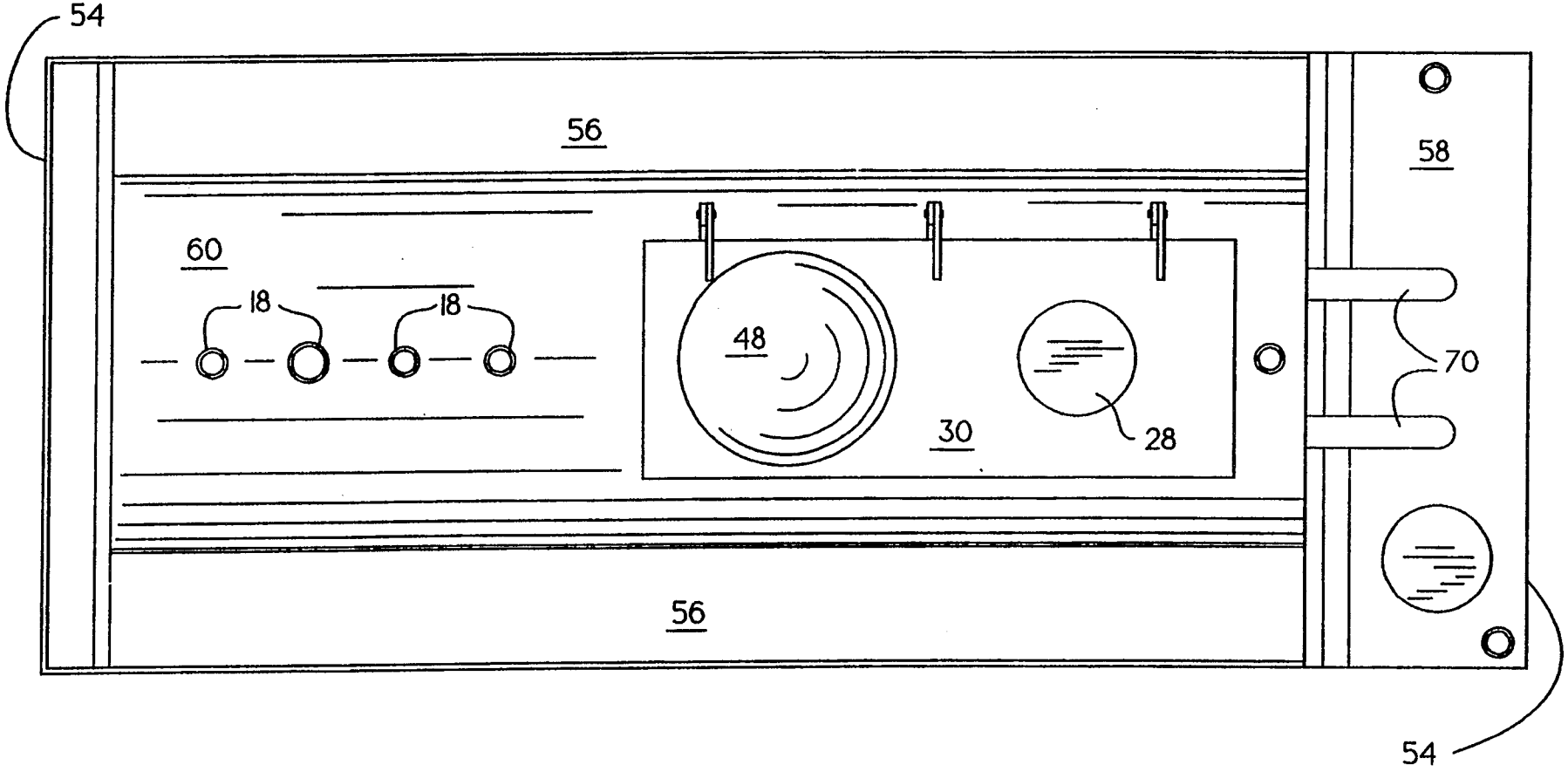
FIG. 9 is a top plan view of the embodiment of FIG. 8.
Figure 10:
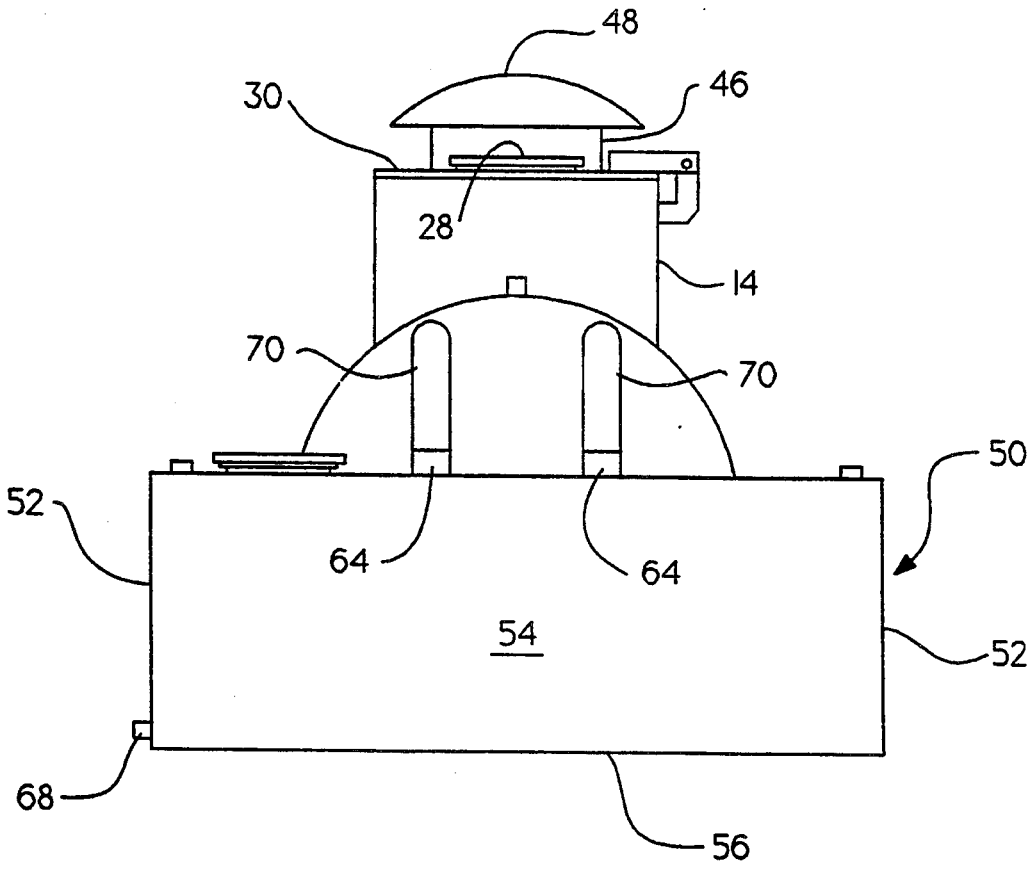
FIG. 10 is an end elevation as viewed from line X—X of FIG. 8.

The embodiment of the invention shown in FIGS. 7–10, inclusive, includes a dike 50 that is shown in perspective in FIG. 7. The dike 50 has side walls 52, end walls 54 and a bottom wall 56. The dike is liquid-tight and impervious to the type of liquid to be utilized in the system. A spill storage chamber 58 is built into the dike adjacent one end wall 54. A liquid storage tank 60 (FIGS. 8–10) is positioned within the dike 50. The liquid storage tank 60 is held in position within the dike 50 by means of welded brackets or the like which form no part of the present invention. The liquid storage tank 60 is identical to the tank of FIG. 6 and has vent fittings 18 as shown in the embodiments of FIGS. 1–5 and FIG. 6; it has a gauge fitting 22 and an inlet port 24 as also shown in those embodiments. A vent 42 with a cover 44 and the vent housing 46 and cover 48 are as shown and described in the embodiment of FIG. 6.

After the liquid storage tank 60 is positioned within the dike 50, the drains 38 of the spill storage chamber 16 are connected to the inlet ports 64 of the dike spill storage chamber 58 by pipes 70. As in the earlier described embodiments, the drains 38 permit the liquid to leave spill storage chamber 16 when it becomes over-full but instead of being uncaptured, the liquid leaving drains 38 is now directed to dike spill storage chamber 58. The dike spill storage chamber 58 has upper drains 66 opening to the interior of dike 50 through which liquid escapes if the dike spill storage chamber 58 becomes overfull and a lower gravity drain 68.

It may be seen that in all the embodiments of the present invention, the inlet ports 26 to the spill storage chamber 16 are positioned at a level above the top of the primary storage chamber 12 but at the same time the level of the inlet ports 26 are well below the level of the emergency vents 20 (FIGS. 1–5) and 42 (FIGS. 6–10) so that the vents are kept clear of the liquid that accumulates in the spill collection chamber 14.

According to the provisions of the patent statutes, I have explained the principle, preferred construction and mode of operation of my invention and have illustrated end described what I now consider to represent its best embodiments. However, it should be understood that, within the scope of the appended claims, the invention may be practiced otherwise than as specifically illustrated and described.

I claim:

1. Apparatus for liquid overflow control of a liquid storage vessel having an inlet port and a vent port comprising:

a spill collection chamber overlying said storage vessel inlet port and said storage vessel vent port and sealing affixed to said storage vessel whereby liquid overflowing from said inlet port or said vent port is contained within said spill collection chamber and may be cleaned therefrom if confined thereto;

a spill storage chamber in fluid communication with said spill collection chamber by means of a spill storage chamber inlet port that extends above the upper wall of said spill storage chamber whereby liquid is accumulated in said spill collection chamber until the liquid level rises above the level of said spill storage chamber inlet port and subsequently enters said spill storage chamber through said spill storage chamber inlet port for storage until removed therefrom.

2. The apparatus of claim 1 wherein said spill collection chamber is formed over the top of a portion of said liquid storage vessel and over the top of a portion of said spill storage chamber.

3. The apparatus of claim 1 wherein said liquid storage vessel and said spill storage chamber are underground.

4. The apparatus of claim 1 wherein said liquid storage vessel and said spill storage chamber are above ground.

5. The apparatus of claim 1 wherein said spill storage chamber is attached to said liquid storage vessel.

6. The apparatus of claim 1 wherein a second spill storage chamber is formed integrally with a box-like dike within which dike said liquid storage vessel is positioned.

7. A vessel for liquid storage comprising:

a primary storage chamber having an inlet pork and a vent port;

a spill collection chamber overlying said inlet port and said vent port whereby liquid overflowing from said inlet port or said vent port is contained within said spill collection chamber and may be cleaned therefrom if confined thereto; and a spill storage chamber attached to said primary storage chamber and in fluid communication with said spill collection chamber by means of a spill storage chamber inlet port that extends above the upper wall of said spill storage chamber whereby liquid is accumulated in said spill collection chamber until the liquid level rises above the level of said spill storage chamber inlet port and subsequently enters said spill storage chamber through said spill storage chamber inlet port for storage until removed therefrom.

8. The vessel of claim 7 wherein said primary storage chamber is a double-walled tank.

9. The vessel of claim 7 wherein said spill collection chamber is formed over the top of a portion of said primary storage chamber and over the top of a portion of said spill storage chamber.

10. The vessel of claim 7 wherein said primary storage chamber and said spill storage chamber are underground.

11. The vessel of claim 7 wherein said primary storage chamber and said spill storage chamber are above ground.

12. A vessel for liquid storage comprising:

a cylindrical primary storage chamber positioned with its cylindrical axis in a horizontal direction and having an inlet port and a vent port opening through the upper cylindrical surface of said primary storage chamber;

a cylindrical spill storage chamber attached to one end of said primary storage chamber and axially aligned with said cylindrical primary storage chamber, said cylindrical spill storage chamber having an inlet port extending above its upper cylindrical surface and at least one drain port in the end wall of said cylindrical spill storage chamber;

a spill collection chamber positioned over a portion of said primary storage chamber upper cylindrical surface and surrounding said primary storage chamber inlet port and vent port and positioned over a portion of said spill storage chamber upper cylindrical surface in fluid communication with said spill storage chamber inlet port whereby liquid leaving said primary storage chamber through said inlet port or said vent port is collected within said spill collection chamber and may be cleaned therefrom until the liquid level rises above the level of said spill storage chamber inlet port and subsequently enters said cylindrical spill storage chamber through said spill storage chamber inlet port.

13. The vessel of claim 12 wherein said cylindrical primary storage chamber and said cylindrical spill storage chamber are above ground.

14. A vessel for the storage of liquid petroleum products comprising:

a cylindrical primary storage chamber positioned with its cylindrical axis in a horizontal direction and having an inlet port and a vent port, said inlet port being raised above the upper cylindrical surface of said primary storage tank and having a filler pipe extending from said inlet port down into said primary storage chamber, said vent port being raised above said upper cylindrical surface of said primary storage tank to a higher level than said inlet port;

a cylindrical spill storage chamber having the same diameter as said cylindrical primary storage chamber attached to one end of said primary storage chamber and axially aligned with said cylindrical primary storage chamber, said cylindrical spill storage chamber having an inlet port in its upper cylindrical surface being raised above said upper cylindrical surface but below the level of said cylindrical primary storage chamber vent port, said cylindrical spill storage chamber having a lower drain in its end wall and an overfill emergency upper drain in its end wall;

a spill collection chamber positioned in fluid tight relationship over a portion of said primary storage chamber upper cylindrical surface and enclosing said primary storage chamber inlet port and vent port and positioned in fluid tight relationship over a portion of said spill storage chamber upper cylindrical surface in fluid communication with said spill storage chamber inlet port whereby fluid leaving said primary storage chamber through said inlet port or said vent port is collected within said spill collection chamber and may be cleaned therefrom until said liquid reaches the level of said cylindrical spill storage chamber inlet port and thereafter enters said cylindrical spill storage chamber through said inlet port.

15. The vessel of claim 14 wherein said primary storage chamber is a double-walled tank.

16. The vessel of claim 14 wherein said primary storage chamber and said spill storage chamber are underground.

17. The vessel of claim 14 wherein said primary storage chamber and said spill storage chamber are above ground.

18. The vessel of claim 14 wherein said vessel is positioned within a dike for containing overflow from said spill collection chamber, said dike including:

a box-like dike body that is impervious to the liquid being stored in said liquid storage vessel and a second spill storage chamber formed integrally with said dike body and having an inlet port connected to said overfill emergency upper drain in said cylindrical spill storage chamber.

19. The dike of claim 18 wherein said second spill storage chamber is positioned contiguous to an end wall of said box-like dike.

* * * * *